US005842621A

United States Patent [19]

Gschwind

[11] Patent Number: 5,842,621

[45] Date of Patent: Dec. 1, 1998

[54] GOLF UTENSILS CARRYING DEVICE

[76] Inventor: Donata Marialuisa Gianesi Gschwind, Gsteigstrasse 17, CH-8703 Erlenbach, Switzerland

[21] Appl. No.: 582,091

[22] Filed: Jan. 2, 1996

[30] Foreign Application Priority Data

Jan. 17, 1995 [CH] Switzerland ..... 00129/95

[51] Int. Cl.[6] ..... A45F 3/00

[52] U.S. Cl. ..... 224/682; 224/665; 224/666; 224/247; 224/248; 224/901.8; 224/918; 224/919; 224/251; 224/223

[58] Field of Search ..... 224/919, 918, 224/666, 669, 668, 901.8, 678, 250, 251, 248, 247, 665, 660, 682, 223; 206/315.9

[56] References Cited

U.S. PATENT DOCUMENTS

| | | | |
|---|---|---|---|
| 1,610,344 | 12/1926 | Williams | 224/919 |
| 2,558,382 | 6/1951 | Previdi | 224/918 |
| 2,708,061 | 5/1955 | Kotchka | 224/919 |
| 3,753,519 | 8/1973 | Gammon | 224/918 |
| 4,061,256 | 12/1977 | Beer et al. | 224/919 |
| 4,065,040 | 12/1977 | Steere | 224/919 |
| 4,069,954 | 1/1978 | Rauch | 224/918 |
| 4,129,237 | 12/1978 | Grinder | 224/918 |
| 4,836,427 | 6/1989 | McManus | 224/919 |
| 5,031,812 | 7/1991 | Gustine | 224/918 |
| 5,240,156 | 8/1993 | Sicotte et al. | 224/901.8 |
| 5,386,906 | 2/1995 | Lai | 224/919 |
| 5,517,696 | 5/1996 | Krugler | 224/918 |

FOREIGN PATENT DOCUMENTS

| | | | |
|---|---|---|---|
| 5329239 | 12/1993 | Japan | 206/315.9 |

*Primary Examiner*—Linda J. Sholl
*Attorney, Agent, or Firm*—Ian F. Burns

[57] ABSTRACT

The carrying device consists of a belt (1), a carrying element (3) and a ball holder (2) detachable from the belt. The carrying element (3) has pockets for receiving a pitch mark remover (34) and two tees (37) and is fastened by means of a Velcro fastener (16, 38) to the belt (1). The ball holder (2) has two elastic rings (21), which are connected to each other by strips (23, 24). The carrying device enables easy carrying of the necessary golf utensils without interferring with the swing motion and without disturbing the concentration of the player.

4 Claims, 1 Drawing Sheet

GOLF UTENSILS CARRYING DEVICE

A golfplayer has to carry several utensils with him when golfing. Problems arise, should a player have to walk from the tee-off back to his cart in order to fetch a second ball or a forgotten tee, as he causes the game to slow down on the whole golf course. Therefore many players carry the most important utensils with them in the pockets of their clothing. This however proves unsatisfactory, because these utensils fall out easily, when the handkerchief is pulled out, or because their bulkiness reduces the concentration and the flow of the golf swing.

A golf utensils carrying device is disclosed in GB-A-2 063 647. It consists of a belt, to which a strip is riveted in loops. The last loop is elongated and carries a cross strip, of which the ends are also riveted to the belt. This last loop serves as receptacle for a golf ball. The other loops serve to receive two markers and a towel. The markers are inserted from the top. Their pointers sit in slots provided in the upper edge of the strip. Another strip, also shaped in loops and affixed by rivets, serves the insertion of two tees and a pitch mark remover. Moreover a pocket for receiving a score card and a pencil may be detachably affixed. This belt can not be threaded through the belt carriers of clothing, but must be worn apart. Thus it moves around and may cause a hindrance to the player besides making the accessibility of the receptacles more difficult.

The belt's width would have to measure at least the tee's length (about 5.5 cm, 2 inches), in order to keep their tips from bothering the player. Subsequently, this also leads to a hindrance of the player. The belt end sticking freely out of the belt buckle overlaps and covers beyond the markers and therefore renders them more difficult to reach. The belt is only suitable for a right-handed person. It can only be worn in one direction, as otherwise the markers would drop to the floor.

The U.S. Pat. No. 4,836,427 discloses a belt to which tennis ball retainer cages are permanently attached. The cages consist of two annular elastic bands sewn to the belt and parallel elastic strips connecting these annular bands. If a ball is being pressed into this soft construction the strips and bands are pressed together and the capacity vanishes. Therefore the tennis ball retainer cage can hardly be served by one hand only. This belt also can not be threaded through the belt carriers of clothing.

The U.S. Pat. No. 4,294,386 discloses another tennis ball holder. It consists of a circle of synthetic material, from which three fingers extend downward as well as a clip to be fastened on a garment. The six edges of the free ends of these fingers present a danger of injury for the player. Also, the ball can only be pressed in the holder from the top.

The U.S. Pat. No. 3,674,189 discloses a carrying device for two tees, one pitch mark remover and one marker, which may be fastened to a belt. On teeing off this holder dangles from the belt and may irritate the concentrating player. A similar holder is described in the U.S. Pat. No. 4,129,237.

The U.S. Pat. No. 2,009,325 describes a belt, which consists of three glued strips of fabric. The longside edges are trimmed with stitched on cords.

The invention at issue has the purpose to be a carrying device for golf utensils, which does not interfere in anyway with the movements of the player and which is very easy to handle. According to the invention this is reached by a carrying device consisting of a belt, on which is detachably affixed a carrying element to receive at least one tee, one pitch mark remover and one marker and a ball holder which is detachable from the belt.

An example of the invention is shown in the drawing, in which.

Figure 1:
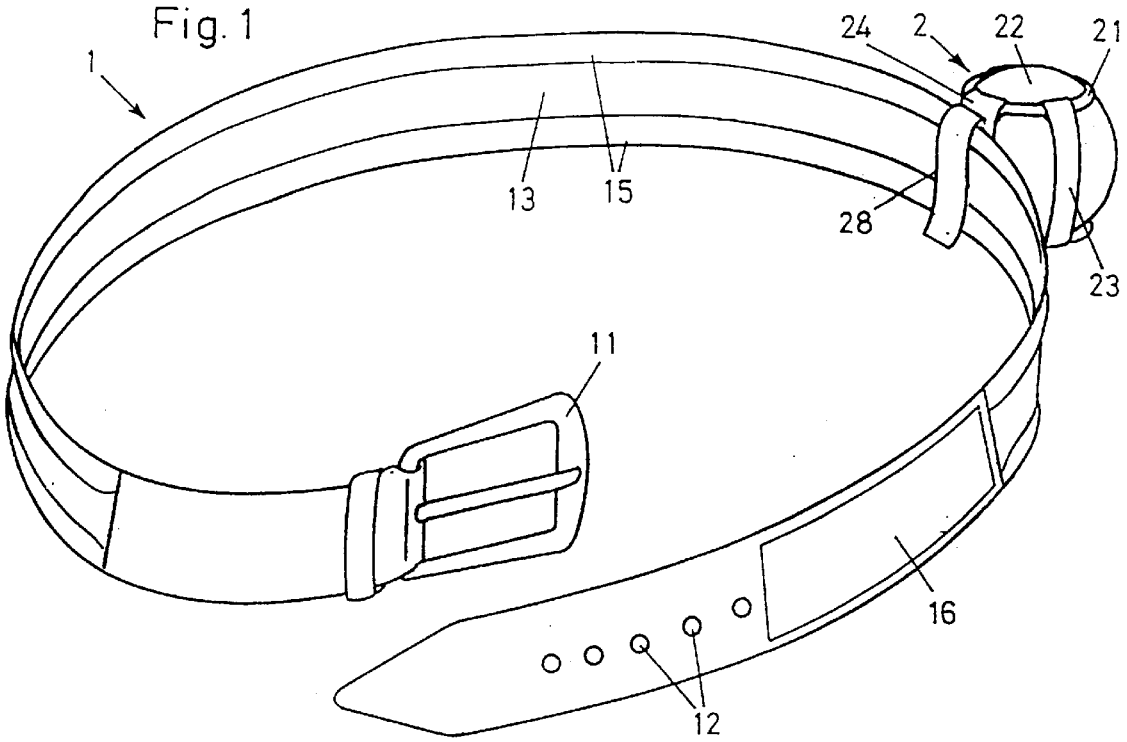
FIG. 1 shows a belt with a ball holder.
Figure 2:
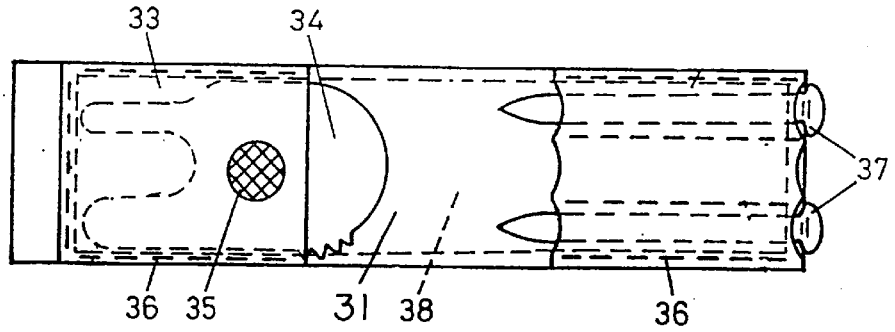
FIG. 2 shows a carrying element to be attached to the belt.
Figure 3:
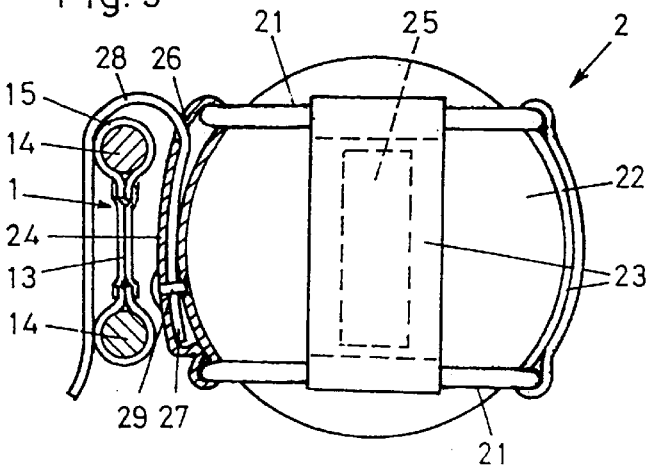
FIG. 3 shows a side view of the ball holder.

The carrying device consists of a belt 1, a ball holder 2 detachably affixed to the belt and a carrying element 3. The belt is made of leather over its entire width round about the buckle 11 and the holes 12. In between it shows a strap of leather 13, of which soft cords 14 trim its sides. Both cords are covered with a textile strip 15 e.g. rucksack nylon, which is sewn to the leather strap 13. With the help of the cords 14 and the strips 15 the edges of the strap 13 are softly padded. This way the belt 1 will not cut in the waist when twisting for driving. Following the row of holes 12 the "non sticky" part 16 of a Velcro fastener is sewn on the belt, i.e. the part with the slings.

The ball holder 2 consists of two tensionally elastic rings 21, e.g. of metallic helical springs. Their internal diameter in an untensioned state is smaller than the diameter of a golfball 22. They are connected by four leather strips 23, 24. The strips 23, 24 are double-layered and form pockets. In the pockets of the strips 23 blades 25, which are elastic on bending, e.g. of stainless spring steel, are inserted. The outer layer of the strip 24 has a slit 26 at the top, through which the shank 27 of a u-shaped clip 28 of stainless spring steel is stuck and fastened with a rivet 29. The other shank of the clip is fastened on a suitable position of the belt, i.e. the movements of the player are not hindered. The described ball holder 2 allows a very easy inserting and removing of a golf ball 22 from the top or from underneath and still provides a secure hold of the ball. Due to this the ball holder can easily be worn on the back. There the ball is well stowed away and does not interfere with the flow of the movement. The stiff reinforcement by the help of blades 25 makes a handling by one hand possible. To prevent the ball from dropping out between the strips 23 these are preferably considerably wider than shown in FIG. 1.

The carrying element 3 consists of a leather patch 31, on which two leather pieces 32, 33 are sewn along the long sides. The leather piece 33 has a stitched-on part reaching down to its center. This way a pocket to receive the pitch mark remover 34 is formed. On the right side an element of a press fastenener is affixed on the leather piece 33 where a marker 35 can be stowed away, which carries on its inferior side the male part of a press fastener. On the leather piece 32 two enclosed seams 36 form three further pockets to receive two or three tees 37. The leather pieces 32, 33 are combined on the inside with an elastic, textile band to ensure the safe hold of pitch mark remover 34 and tees. On the back of the leather patch 31 the other part 38 of the Velcro fastener is sewn, i.e. the part with the projecting hooks. After having threaded the belt 1 into the belt carriers of the pants or the skirt, the carrying element 3 is fastened by means of the Velcro fastener. This is always possible regardless of the position of the belt carriers of any clothing design. The position of the carrying element 3 between front and side of the waist as well as its flat shape make sure, that the golf swing will not be hindered in any way. Since the tees are inserted in a longitudinal direction on the belt, their points do not bother either. The carrying element 3 has the width of a regular belt.

The variable fastening possibilities of the carrying element 3 and the ball holder 2 make threading and pulling out of the belt 1 through the belt carriers no problem with any clothing-example. Without the accessories the belt 1 may be worn as a regular sporty belt after the game. It may be threaded through the belt carriers from the right as well as from the left. Thanks to firm fixations the carrying element 3 and the ball holder 2 do not dangle and therefore neither disturb the movement nor the concentration. Thanks to the simplicity of the shapes the separate parts unite to an elegant total.

I claim:

1. A device for carrying golf utensils, comprising:

(A) a belt for attaching to a user, said belt being adapted to be threaded through belt loops on pants;

(B) a carrying element for carrying instruments used in golfing, said carrying element being removably attachable to said belt and comprising at least one pocket for carrying an instrument used in golfing; and (C) a ball holder removably attachable to said belt for carrying a golf ball, said ball holder comprising:

(a) at least two rings for providing a holding structure, at least one of said rings being elastic wherein the inner diameter of said elastic ring in an un-tensioned state is smaller than the diameter of the ball; and (b) at least one band for connecting said rings, wherein said band is reinforced by a metal blade.

2. The device in claim 1 wherein said carrying element is attachable to said belt by a hook and loop fastening material on said belt and on said carrying element.

3. A ball holder for carrying a ball on a belt, comprising:

(A) at least two rings for providing a holding structure, at least one of said rings being elastic wherein the inner diameter of said elastic ring in an un-tensioned state is smaller than the diameter of the ball;

(B) at least one band for connecting said first and second rings, wherein said band is reinforced by a metal blade; and (C) means for attaching said rings to the belt.

4. A device for holding a golf ball on a belt, comprising:

(A) a first and second ring for providing a holding structure, at least one of said rings being an elastic spring wherein the inner diameter of said elastic spring in an un-tensioned state is smaller than the diameter of the golf ball;

(B) at least one band for connecting said first and second rings, said band including at least one metal blade for stiffening said band; and (C) means for attaching said rings to the belt.

* * * * *